US007469898B2

(12) United States Patent
Forakis

(10) Patent No.: US 7,469,898 B2
(45) Date of Patent: Dec. 30, 2008

(54) GEOMETRIC PUZZLE KITS

(76) Inventor: Peter Forakis, 106 Washington St., #232, Petaluma, CA (US) 94952

( * ) Notice: Subject to any disclaimer, the term of this patent is extended or adjusted under 35 U.S.C. 154(b) by 84 days.

(21) Appl. No.: 11/398,495

(22) Filed: Apr. 5, 2006

(65) Prior Publication Data

US 2007/0235928 A1 Oct. 11, 2007

(51) Int. Cl.
*A63F 9/12* (2006.01)
*A63H 33/08* (2006.01)

(52) U.S. Cl. ..... 273/156; 273/160; 273/157 R; 446/114; 446/125

(58) Field of Classification Search ..... 273/153 R, 273/157 R, 156, 155, 160; 446/114, 115, 446/122, 124, 125; D21/491
See application file for complete search history.

(56) References Cited

U.S. PATENT DOCUMENTS

| | | | | | |
|---|---|---|---|---|---|
| 1,311,337 | A * | 7/1919 | Fredson | 446/114 |
| 2,977,701 | A | 4/1961 | Louderback | 428/8 |
| 3,537,706 | A * | 11/1970 | Heavener, Jr. | 273/459 |
| 3,564,758 | A | 2/1971 | Willis | 446/109 |
| 3,698,124 | A | 10/1972 | Reitzel et al. | 446/114 |
| 3,855,748 | A * | 12/1974 | Thomas | 446/115 |
| 3,940,010 | A | 2/1976 | Sears | 220/23.86 |
| 5,163,862 | A | 11/1992 | Philips et al. | 446/114 |
| 5,525,060 | A * | 6/1996 | Loebner | 434/171 |
| 5,628,666 | A | 5/1997 | Tomczyk et al. | 446/125 |
| 5,762,336 | A | 6/1998 | Miller, Jr. | 273/160 |
| 5,827,104 | A * | 10/1998 | Zheng | 273/160 |
| 5,833,512 | A | 11/1998 | Nicola | 446/114 |
| 6,149,487 | A | 11/2000 | Peng | 446/114 |
| 6,439,945 | B1 | 8/2002 | Liu | 446/71 |
| 6,761,354 | B2 * | 7/2004 | Pavlovits | 273/156 |

FOREIGN PATENT DOCUMENTS

| | | |
|---|---|---|
| EP | 1530990 | 11/2004 |

* cited by examiner

*Primary Examiner*—Steven Wong
(74) *Attorney, Agent, or Firm*—Fulbright & Jaworski, LLP

(57) ABSTRACT

The invention provides a geometric puzzle having a plurality of flat square and rectangular elements with slots that allow the elements to be sequentially interlocked to form two separate geometric shapes, the smaller shape (4-D Qube) being capable of fitting into the larger (Archimedes Qube) to form one geometric structure.

10 Claims, 6 Drawing Sheets

(6)

(12)

GEOMETRIC PUZZLE KITS

BACKGROUND OF THE INVENTION

1. Field of the Invention

The present invention lies in the general field of puzzles. More specifically, the invention provides kits and planar puzzle pieces for the assembly of two specific puzzle structures, one capable of fitting inside the other.

2. Description of Related Art

Construction toys and puzzles have been known for centuries. Such toys comprise a plurality of identical or similar shaped objects that fit together to form one or more two- or three-dimensional designs. Most construction toys permit multiple assembly options, whereas most puzzles permit only one or a few potential assemblages. There remains a need for new and challenging puzzle/construction toys.

SUMMARY OF THE INVENTION

Thus, in accordance with the present invention, there is provided a puzzle kit comprising (a) two square pieces, each of said square pieces comprising a notch at one corner, said notch being at a 45 degree angle to the adjacent sides of said square pieces; (b) one of a first rectangular piece, said first rectangular piece having two short sides equivalent in length to a side of said square pieces, and two long sides each twice the length of a side of said square pieces, each of said first rectangular piece having two notches at the corners of the same long side, said notches being at 45 degree angles to the adjacent sides of said first rectangular piece; and (c) four of a second rectangular piece, said second rectangular pieces having two short sides equivalent in length to a side of said square pieces, and two long sides twice the length of a side of said square pieces, each of said second rectangular pieces having a first notch at a corner of said second rectangular pieces, said first notch being at a 45 degree angle to the adjacent sides of said second rectangular pieces, and a second notch at the center of the long side opposite said first notch, said second notch being at a 45 degree angle to said long side, and perpendicular to said first notch.

The kit may further comprise one or more receptacles for storage of the pieces. The pieces may be comprised of wood, plastic (e.g., PVC), metal (e.g., anodized aluminum) or cardboard. The square pieces may be 1" by 1", and the rectangular pieces may be 1" by 2". Alternatively, the square pieces may be 3" by 3", and the rectangular pieces may be 3" by 6". Alternatively, the square pieces may be 6" by 6", and the rectangular pieces may be 6" by 12". The pieces may be assembled into a 4-D Qube.

In another embodiment, there is provided a puzzle kit comprising (a) six square pieces, each of said square pieces comprising a notch at each comer, said notches being at a 45 degree angle to the adjacent sides of said square pieces; (b) twelve rectangular pieces, said rectangular pieces having two short sides each one-half the length of a side of said square pieces, and two long sides each equivalent in length to a side of said square pieces, each of said rectangular pieces having two notches, one at each corner of the same long side, said notches being at 45 degree angles to the adjacent sides of said rectangular pieces.

The kit may further comprise one or more receptacles for storage of the pieces. The pieces may be comprised of wood, plastic (e.g., PVC), metal (e.g., anodized aluminum) or cardboard. 9. The square pieces may be 2" by 2", and the rectangular pieces may be 1" by 2". Alternatively, the square pieces may be 3" by 3", and the rectangular pieces may be 1.5" by 3".

Alternatively, the square pieces may be 6" by 6", and the rectangular pieces may be 3" by 6". Alternatively, the square pieces may be 12" by 12", and the rectangular pieces may be 6" by 12". The pieces may be assembled into an Archimedes Qube.

In still yet another embodiment, there is provided a puzzle kit comprising (a) two of a first square piece, each of said first square pieces comprising a notch at one corner, said notch being at a 45 degree angle to the adjacent sides of said square pieces; (b) thirteen of a first rectangular piece, said first rectangular piece having two short sides equivalent in length to a side of said first square pieces, and two long sides each twice the length of a side of said first square pieces, each of said first rectangular piece having two notches at the corners of the same long side, said notches being at 45 degree angles to the adjacent sides of said first rectangular piece; (c) four of a second rectangular piece, said second rectangular pieces having two short sides equivalent in length to a side of said first square pieces, and two long sides twice the length of a side of said first square pieces, each of said second rectangular pieces having a first notch at a corner of said second rectangular pieces, said first notch being at a 45 degree angle to the adjacent sides of said second rectangular pieces, and a second notch at the center of the long side opposite said first notch, said second notch being at a 45 degree angle to said long side, and perpendicular to said first notch; and (d) six of a second square piece, said second square pieces having sides twice the length of the sides of said first square pieces, each of said second square pieces comprising a notch at each corner, said notches being at a 45 degree angle to the adjacent sides of said second square pieces.

The kit may further comprise one or more receptacles for storage of the pieces. The pieces may be comprised of wood, plastic (e.g., PVC), metal (e.g., anodized aluminum) or cardboard. The first square pieces may be 1" by 1", the second square pieces may be 2" by 2", and the rectangular pieces may be 1" by 2". Alternatively, the first square pieces may be 3" by 3", the second square pieces may be 6" by 6", and the rectangular pieces may be 3" by 6". Alternatively, the first square pieces may be 6" by 6", the second square pieces may be 12" by 12", and the rectangular pieces may be 6" by 12". The pieces may be assembled into an Archimedes Qube and a 4-D Qube, wherein the 4-D Qube is located inside the Archimedes Qube.

It is contemplated that any method or composition described herein can be implemented with respect to any other method or composition described herein.

The use of the word "a" or "an" when used in conjunction with the term "comprising" in the claims and/or the specification may mean "one," but it is also consistent with the meaning of "one or more," "at least one," and "one or more than one."

It is contemplated that any embodiment discussed in this specification can be implemented with respect to any composition of the invention, and vice versa. Furthermore, compositions and kits of the invention can be used to achieve methods of the invention.

Throughout this application, the term "about" is used to indicate that a value includes the inherent variation of error for the device, the method being employed to determine the value, or the variation that exists among the study subjects.

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a device or a method that "comprises," "has," "contains," or "includes" one or more elements possesses those one or more elements, but is not limited to possessing only those one or more elements or steps. Likewise, an element of a device or method that "comprises," "has," "contains," or "includes" one or more features possesses those one or more features, but is not limited to possessing only those one or more features.

BRIEF DESCRIPTION OF THE DRAWINGS

The following drawings form part of the present specification and are included to further demonstrate certain aspects of the present invention. The invention may be better understood by reference to the drawings in combination with the detailed description of illustrative embodiments presented herein. The following drawings illustrate by way of example and not by limitation.

DESCRIPTION OF ILLUSTRATIVE EMBODIMENTS

Figure 2:
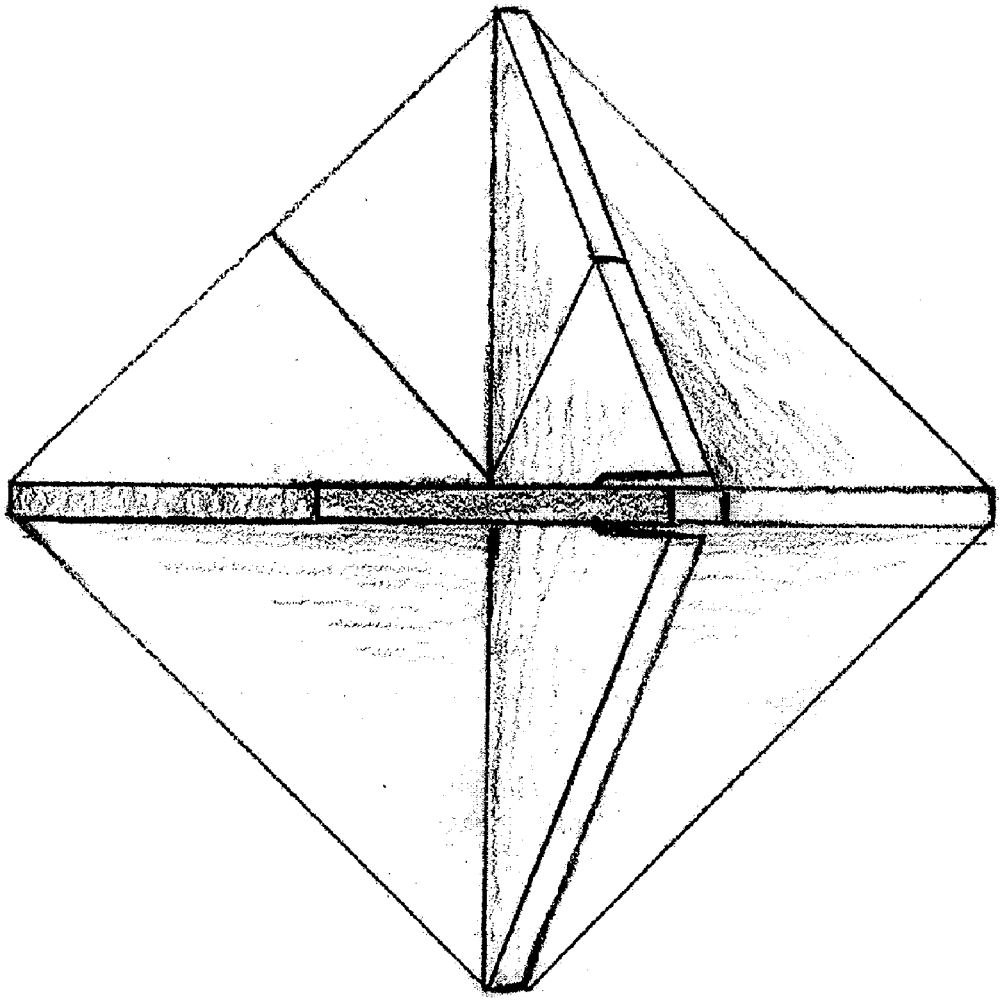
FIG. 2 shows a picture of the fully assembled 4-D Qube.
Figure 3:
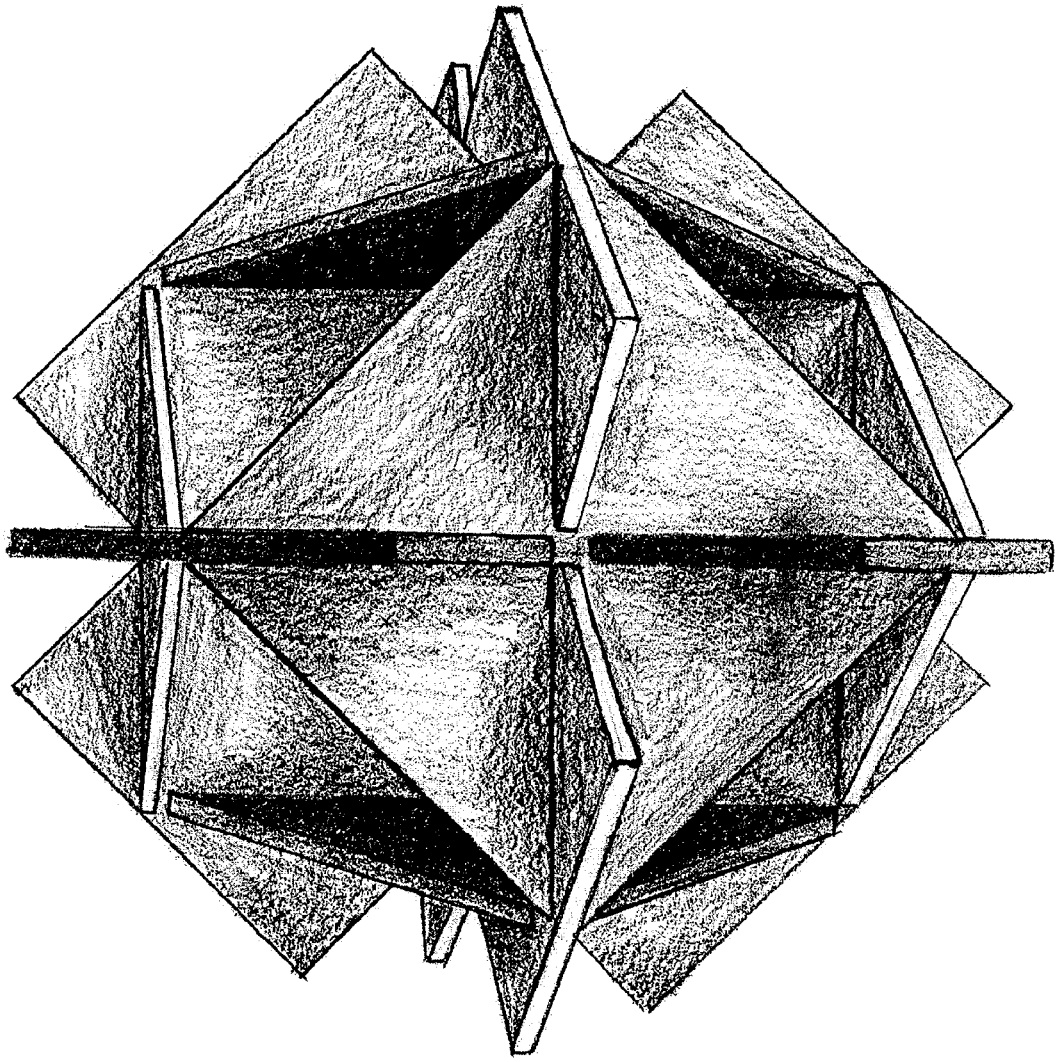
FIG. 3 shows a picture of the fully assembled Archimedes Qube with the fully assembled 4-D Qube inside.
Figure 4:
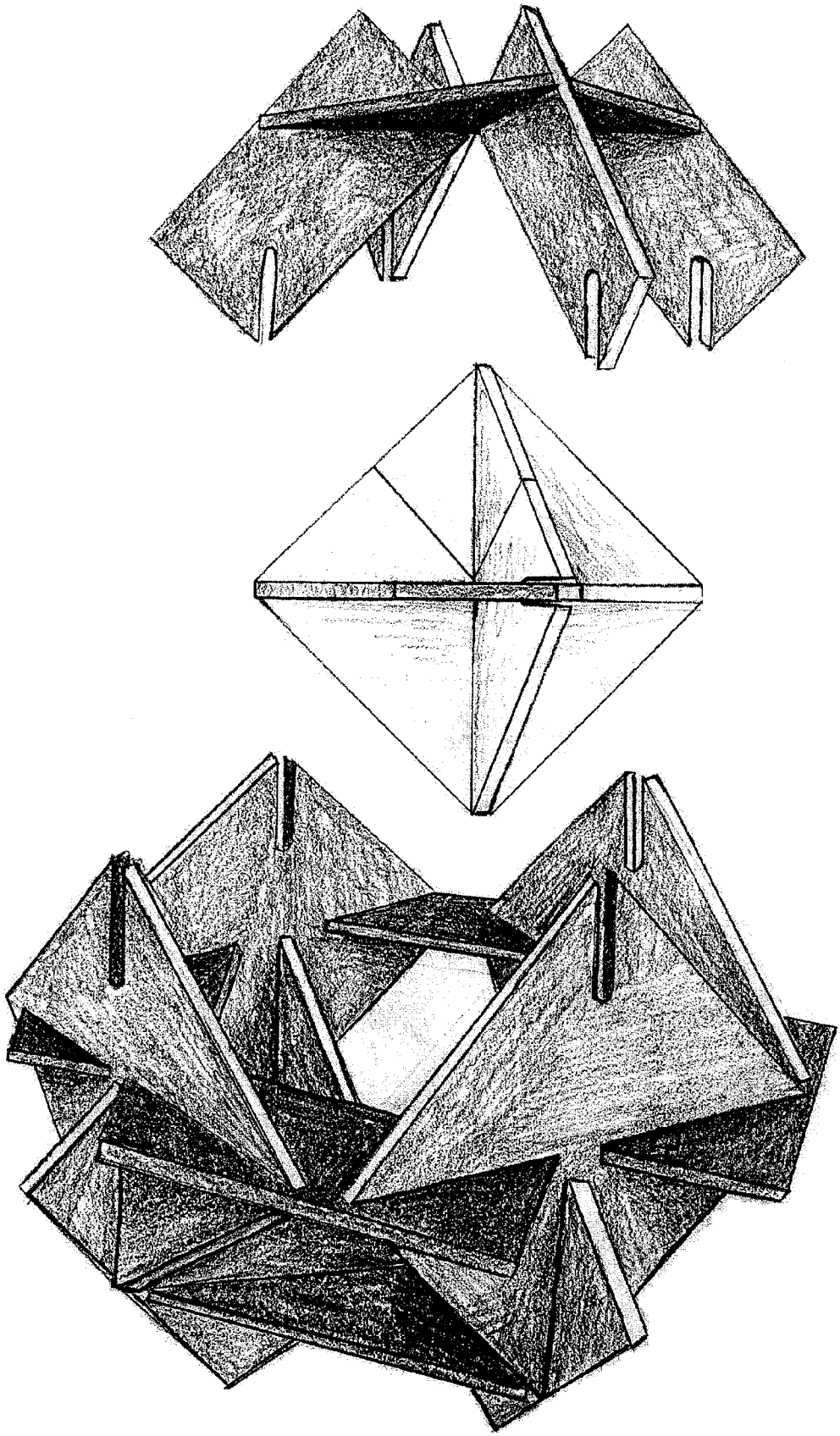
FIG. 4 shows a picture of the fully assembled 4-D Qube positioned in the partially assembled Archimedes Qube.

The present invention involves a geometric puzzle that is composed of two independent structures that may be provided in separate independent puzzle kits or in a combined puzzle kit. The smaller of the component structures is called the "4D Qube" (FIG. 2). The larger component structure is called the "Archimedes Qube" (FIG. 3). The combined puzzles may be completed by assembling both the "4D Qube" (fully) and the "Archimedes Qube" (partially) and then placing the "4D Qube" inside of the "Archimedes Qube" (FIG. 4).

Figure 1A:
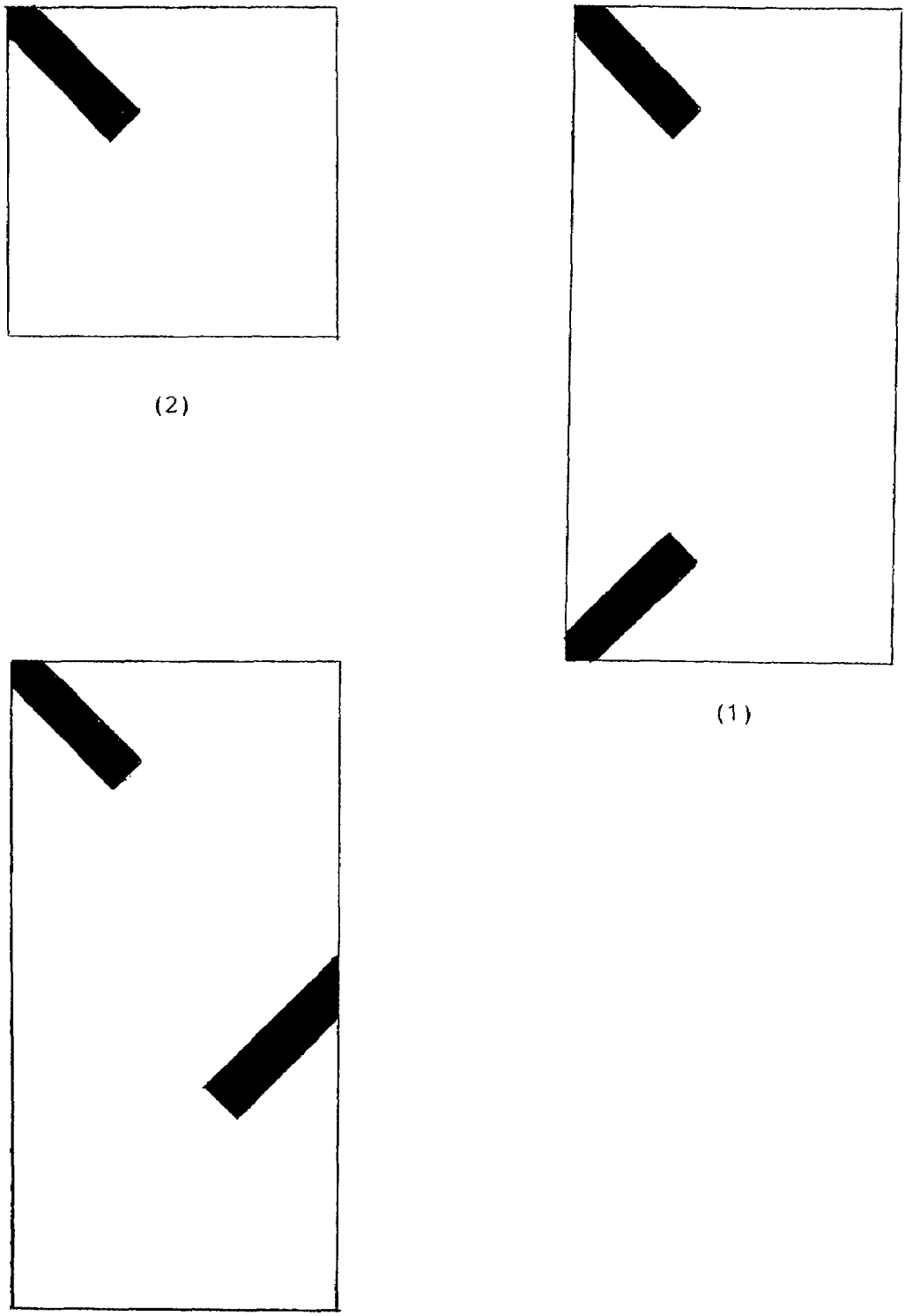
FIG. 1A shows a schematic of pieces for the 4-D Qube (relative sizes are correct).
Figure 1B:
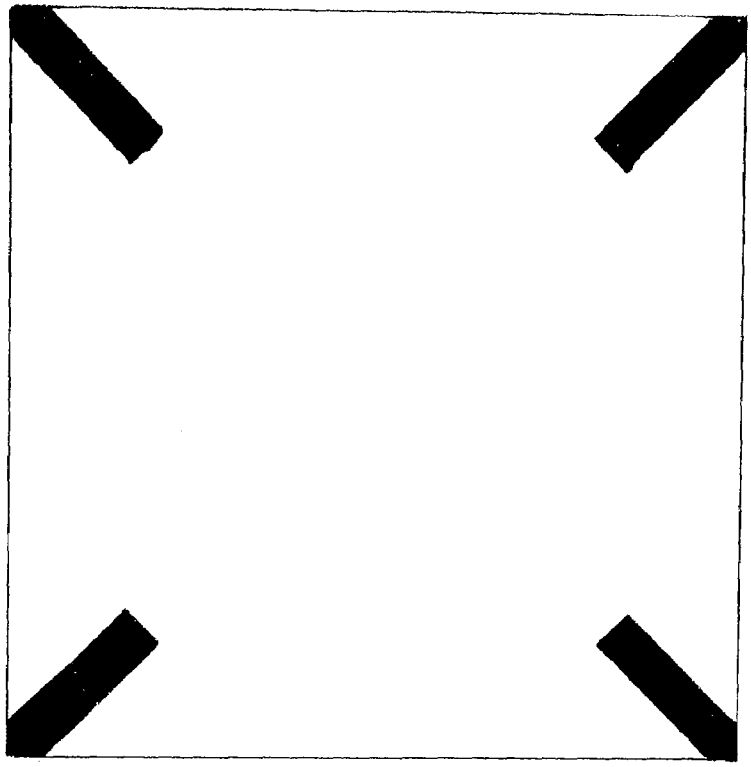
FIG. 1B shows a schematic of pieces for the Archimedes Qube (relative sizes are correct).
Figure 1B:
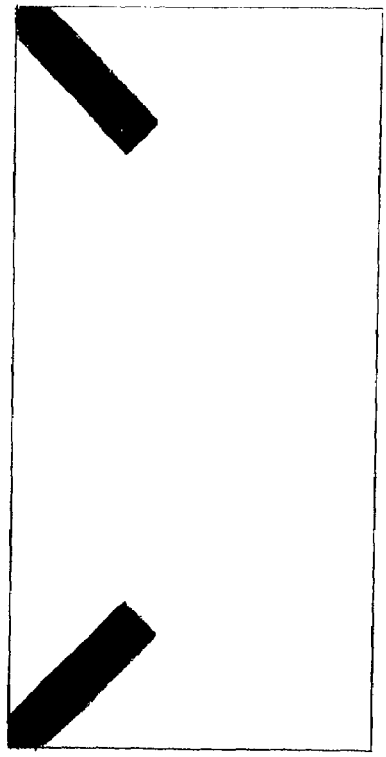
Figure 1C:
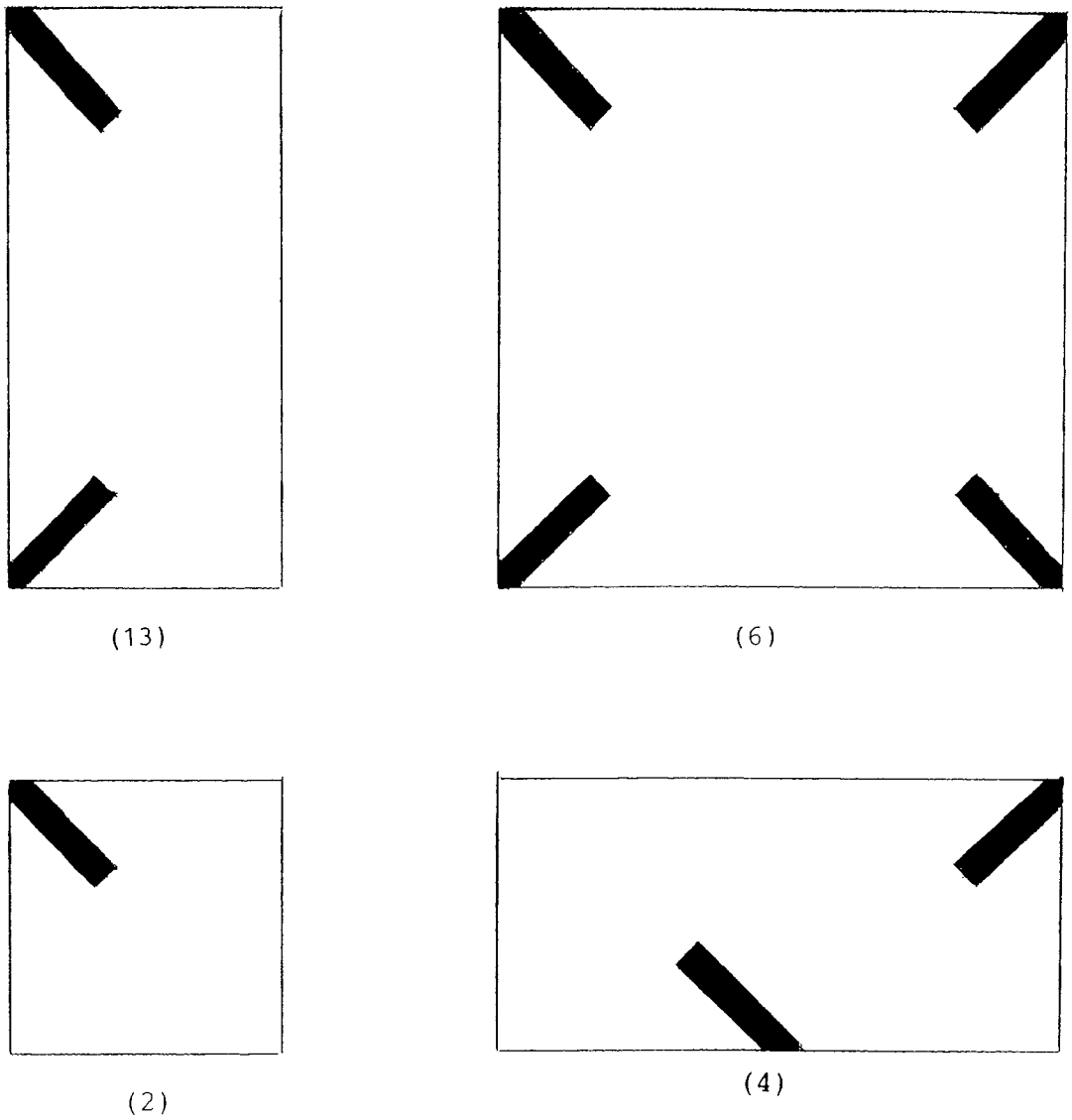
FIG. 1C shows a schematic of pieces for the 4-D and Archimedes Qubes (relative sizes are correct).

Both the "4D Qube" and the "Archimedes Qube" are composed of notched, square and rectangular pieces. When used together, the entire puzzle requires four separate types of pieces for assembly—two types of square pieces and two types of rectangular pieces (FIGS. 1A-1B). The pieces can be any range of sizes, but when used together must retain the appropriate relative sizes. Also, rectangles must always have long:short sides that are of the ratio 2:1. For instance, when the square pieces are 1" by 1" and optionally 2" by 2", then the rectangular pieces of the kit must be 1" by 2". When the square pieces are 3" by 3" and optionally 6" by 6", then the rectangular pieces must be 3" by 6". When the square pieces are 6" by 6" and optionally 12" by 12", then rectangular pieces must be 6" by 12".

The first type of square piece has a notch in only one of its corners that extends toward the center of the square at a 45 degree angle to its adjacent sides. The second type of square piece is slotted at all four corners, such notches extending toward the middle of the piece at 45 degree angles to their adjacent sides. When the two types of square pieces are used together, the second square pieces must have sides twice the length of the sides of the first square pieces.

In addition to the square pieces, there are two different rectangular pieces. The first type of rectangular piece has two notches on the corners of the same long side that extend into the piece at 45 degree angles to their adjacent sides. The second type of rectangular piece also has two notches, but differently angled from the first rectangular piece. On the second rectangular piece, the first notch extends from a comer of the piece into the rectangle at a 45 degree angle to its adjacent sides. The second notch begins in the center of the long side opposite to the first notch, and proceeds into the piece at a 45 degree angle to the long side and perpendicular to the first notch.

The pieces of the puzzle are generally the same thickness. All puzzle notches are equivalent to or slightly larger than the thickness of any piece to allow the notch to tightly grip either the flat portions of another piece or the correct corresponding notch. The notching of the pieces is angled and designed to allow proper assembly of the geometric puzzle.

Assembly of the "4D Qube" requires two of the first square pieces that have one notch, one of the first rectangular pieces, and four of the second rectangular pieces. To assemble the "4D Qube," one begins with the rectangle with two notches on the same side, which is combined with notched rectangles successively to form the four intersecting planes of the octahedron. The two square pieces are added last, together forming the last missing rectangle. When assembled, the "4D Qube" forms the skeletal frame of an octahedron; a solid with eight triangular faces. This "Qube" can function as its own independent puzzle or form the centerpiece of the "Archimedes Qube."

Assembly of the "Archimedes Qube" requires six of the second square pieces that have four notches and twelve of the first rectangular pieces having two notches at the corners. To assemble the "Archimedes Qube," the notched rectangles are added to each of two of the squares so that they support the square horizontally. One such composite unit, with the bulk of each rectangle extending up, forms the base of the Archimedes Qube; the other composite unit, with the bulk of each rectangle extending down, forms the top of the Archimedes Qube. The four remaining squares are connected (standing on their tips in a diamond shape) by means of the last four rectangular pieces, which form a horizontal band and stabilize the four squares into a third composite unit. This unit is used to connect the base and the top of the Qube, inserting the bottom notches of the central squares/diamonds into the remaining open notches of the rectangles of the base unit. Then the top unit's notched rectangles are lowered into the top notches of the central squares/diamonds. The "Archimedes Qube" can function as its own independent puzzle or be combined with the "4D Qube" to form one complete puzzle.

The pieces may be made out of almost any material such as wood, plastic, metal, or cardboard. In particular, plastics such as polyvinylchloride (PVC) are contemplated, as are lightweight metals, such as anodized aluminum. Each puzzle kit may also contain one or more receptacles for storage of all the puzzle pieces, such as a cardboard or plastic box, optionally with dividers or bags to keep the pieces separate.

It is the intended purpose of this invention to create a dynamic puzzle that can be used educationally or recreationally to stimulate the hands and mind, or to simply be used aesthetically as an abstract conversation piece. The nature of these pieces allows them to be combined multiple creative ways; however, the intended purpose of the pieces is to be combined strategically to form the "4D Qube" and "Archimedes Qube" puzzles.

* * * * * * * * * * * * *

All of the compositions and methods disclosed and claimed herein can be made and executed without undue experimentation in light of the present disclosure. While the compositions and methods of this invention have been described in terms of preferred embodiments, it will be apparent to those of skill in the art that variations may be applied to the compositions and methods and in the steps or in the sequence of steps of the methods described herein without departing from the concept, spirit and scope of the invention. More specifically, it will be apparent that certain agents which are both chemically and physiologically related may be substituted for the agents described herein while the same or similar results would be achieved. All such similar substitutes and modifications apparent to those skilled in the art are deemed to be within the spirit, scope and concept of the invention as defined by the appended claims.

REFERENCES

The following references, to the extent that they provide exemplary details supplementary to those set forth herein, are specifically incorporated herein by reference:

U.S. Pat. No. 3,698,124
U.S. Pat. No. 5,163,862
U.S. Pat. No. 3,940,010
U.S. Pat. No. 5,762,336
U.S. Pat. No. 5,833,512
U.S. Pat. No. 6,149,487
U.S. Pat. No. 3,564,758
U.S. Pat. No. 5,628,666
U.S. Pat. No. 2,977,701
U.S. Pat. No. 6,439,945
EP 1 530 990 A1

What is claimed is:

1. A puzzle kit comprising:

(a) two square pieces, each of said square pieces comprising a notch at one corner, said notch being at a 45 degree angle to the adjacent sides of said square pieces;

(b) one of a first rectangular piece, said first rectangular piece having two short sides equivalent in length to a side of said square pieces, and two long sides each twice the length of a side of said square pieces, said first rectangular piece having two notches at the corners of the same long side, said notches being at 45 degree angles to the adjacent sides of said first rectangular piece; and (c) four of a second rectangular piece, said second rectangular pieces having two short sides equivalent in length to a side of said square pieces, and two long sides twice the length of a side of said square pieces, each of said second rectangular pieces having a first notch at a corner of said second rectangular pieces, said first notch being at a 45 degree angle to the adjacent sides of said second rectangular pieces, and a second notch at the center of the long side opposite said first notch, said second notch being at a 45 degree angle to said long side, and perpendicular to said first notch.

2. The kit of claim 1, wherein said kit further comprises one or more receptacles for storage of said pieces.

3. The kit of claim 1, wherein said pieces are comprised of wood, plastic, metal or cardboard.

4. The kit of claim 1, wherein (a) said square pieces are 1" by 1", and said rectangular pieces are 1" by 2", (b) said square pieces are 3" by 3", and said rectangular pieces are 3" by 6", or (c) said square pieces are 6" by 6", and said rectangular pieces are 6" by 12".

5. The kit of claim 1, wherein all of said pieces are assembled into an arrangement as shown in FIG. 2.

6. A puzzle kit comprising:

(a) two of a first square piece, each of said first square pieces comprising a notch at one corner, said notch being at a 45 degree angle to the adjacent sides of said first square pieces;

(b) thirteen of a first rectangular piece, said first rectangular piece having two short sides equivalent in length to a side of said first square pieces, and two long sides each twice the length of a side of said first square pieces, said first rectangular piece having two notches at the corners of the same long side, said notches being at 45 degree angles to the adjacent sides of said first rectangular piece; and (c) four of a second rectangular piece, said second rectangular pieces each having two short sides equivalent in length to a side of said first square pieces, and two long sides twice the length of a side of said first square pieces, each of said second rectangular pieces having a first notch at a corner of said second rectangular pieces, said first notch being at a 45 degree angle to the adjacent sides of said second rectangular pieces, and a second notch at the center of the long side opposite said first notch, said second notch being at a 45 degree angle to said long side, and perpendicular to said first notch; and (d) six of a second square piece, said second square pieces having sides twice the length of the sides of said first square pieces, each of said second square pieces comprising a notch at each corner, said notches being at a 45 degree angle to the adjacent sides of said second square pieces.

7. The kit of claim 6, wherein said kit further comprises one or more receptacles for storage of said pieces.

8. The kit of claim 6, wherein said pieces are comprised of wood, plastic, metal or cardboard.

9. The kit of claim 6, wherein (a) said first square pieces are 1" by 1", said second square pieces are 2" by 2", and said rectangular pieces are 1" by 2"; (b) said first square pieces are 2" by 2", said second square pieces are 4" by 4", and said rectangular pieces are 2" by 4"; (c) said first square pieces are 3" by 3", and said second square pieces are 6" by 6", and said rectangular pieces are 3" by 6"; or (d) said first square pieces are 6" by 6" square, said second square pieces are 12" by 12", and said rectangular pieces are 6" by 12".

10. The kit of claim 6, wherein all of said pieces are assembled into an arrangement as shown in FIG. 3.

* * * * *